United States Patent [19]

Pinto et al.

[11] Patent Number: 4,854,013

[45] Date of Patent: Aug. 8, 1989

[54] DEVICE FOR FINE-OPENING AND CLEANING FIBER MATERIAL, ETC.

[75] Inventors: Akiva Pinto, Neubulach; Guenter Lucassen, Haltern, both of Fed. Rep. of Germany

[73] Assignee: Hergeth Hollingsworth GmbH, Duelman, Fed. Rep. of Germany

[21] Appl. No.: 176,528

[22] Filed: Apr. 1, 1988

[30] Foreign Application Priority Data

Apr. 7, 1987 [DE] Fed. Rep. of Germany ..... 3711642

[51] Int. Cl.[4] ..... D02J 7/00

[52] U.S. Cl. ..... 19/200; 19/204

[58] Field of Search ..... 19/66 R, 200, 204, 205

[56] References Cited

U.S. PATENT DOCUMENTS

| | | | |
|---|---|---|---|
| 967,446 | 8/1910 | Schmidt | 19/200 |
| 1,987,241 | 12/1931 | MacKenzie | 19/204 |
| 2,676,631 | 4/1954 | Senior et al. | 19/204 |
| 3,769,658 | 11/1973 | Brooks | 19/204 |
| 4,126,913 | 11/1978 | Roberson | 19/204 |
| 4,224,720 | 9/1980 | Morgner et al. | 19/204 |
| 4,345,356 | 8/1982 | Handschuch et al. | 19/200 |

FOREIGN PATENT DOCUMENTS

| | | | |
|---|---|---|---|
| 2431018 | 1/1976 | Fed. Rep. of Germany | 19/200 |
| 177583 | 12/1965 | U.S.S.R. | 19/200 |
| 931874 | 7/1963 | United Kingdom | 19/200 |

*Primary Examiner*—Werner H. Schroeder
*Assistant Examiner*—D. Price
*Attorney, Agent, or Firm*—Cort Flint

[57] ABSTRACT

Textile apparatus is disclosed for fine opening and cleaning textile fiber material. The apparatus includes a filling chamber (3) to which the fiber material is fed having a number of opening rollers (5, 6) in superposed arrangement forming a side of the filling chamber. The opening rollers are followed by a take-off roller (8) from which the fiber material is pneumatically carried away by a suction tube (31). A lower opening roller (6) is preceded by a supply roller (16) having a smaller diameter and rotating at a speed substantially slower than the opening rollers (5, 6).

22 Claims, 1 Drawing Sheet

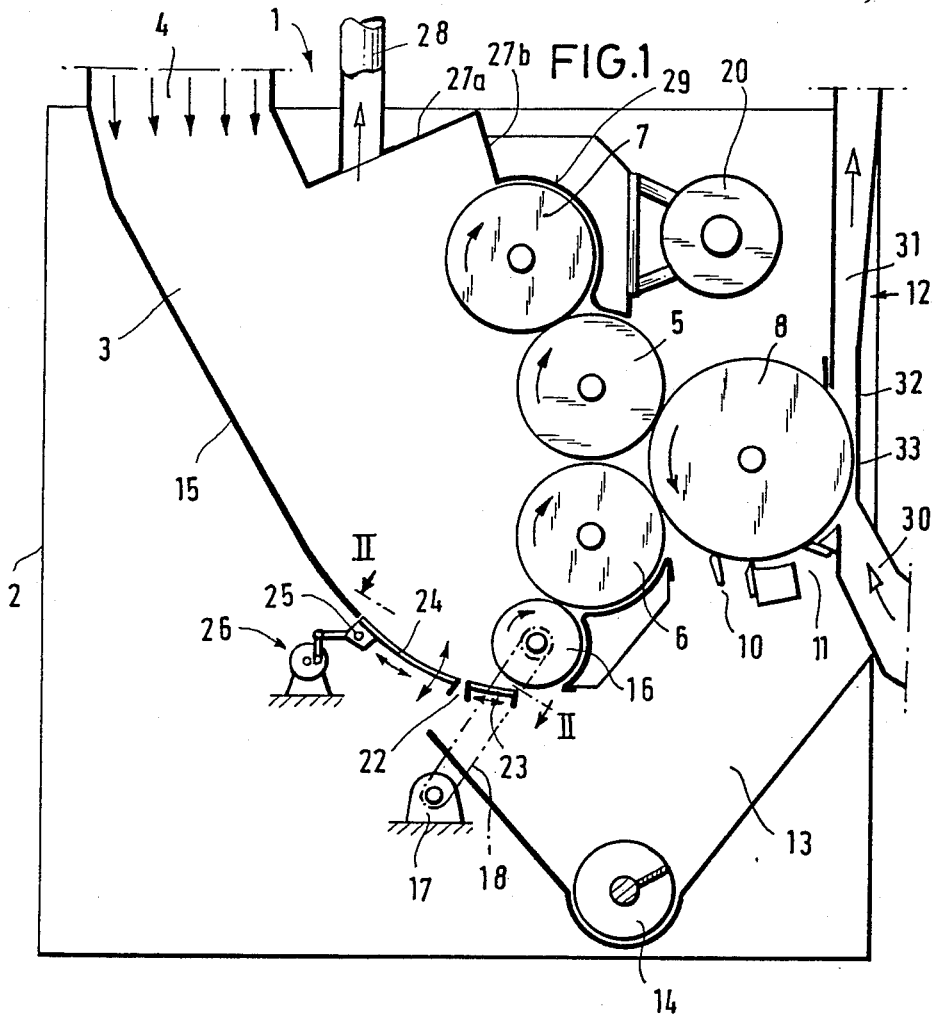
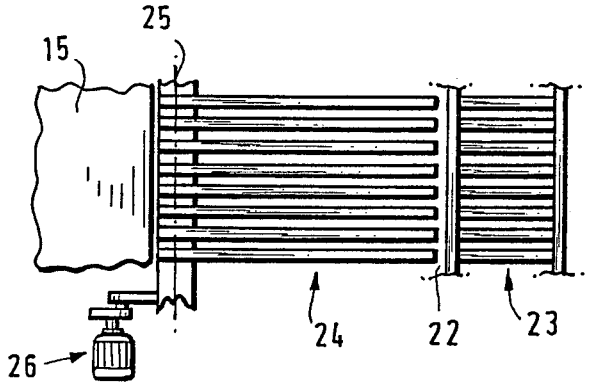
FIG.2

DEVICE FOR FINE-OPENING AND CLEANING FIBER MATERIAL, ETC.

BACKGROUND OF THE INVENTION

The invention relates to a device for the fine opening and cleaning of fiber material, e.g. textile spinning material such as cotton, rayon staple, synthetic textile fibers, etc. In the device, the fiber material is fed to a filling chamber whose lateral portion is formed by a number of opening rollers in superposed arrangement. The opening rollers are followed by a take-off roller cooperating with a cleaning means. The fiber material is removed from the cleaning means by a suction air current through a channel to be supplied to a textile processing machine or the like.

In case of known assemblies of this type the fiber material is loosely presented to the opening rollers. The supply of the fiber material to the opening rollers is performed directly either by means of a lattice or of a gravity chute plate. In both cases, the material supply to the opening rollers does not comply with the requirements. If a lattice is used, the supply may be dosed, but it is susceptible to troubles. The resultant construction of the housing is bulky, and wear of the lattice is considerable. Further, there is a risk of an off-track movement with a probable negative influence on the delivery of the fiber material. With the gravity chute plate, the design of the housing may be compact, but the supply of the fiber material is not well controllable. It is not possible to suddenly stop feeding. A controlled operation is not possible. Hence, the amount of throughput cannot be clearly and troublefree regulated by the device.

It is the object of the invention to provide a device of the foregoing type which is substantially improved in the feeding and control of the amount of fiber material and as to its uniform cleaning and opening.

SUMMARY OF THE INVENTION

The invention is characterized in that a lower opening roller included in a number of superposed rollers is preceded by a supply roller. The supply roller has a smaller diameter which rotates substantially slower than the opening rollers.

Due to the supply roller preceding the opening roller, the material supply may be monitored by simple means in a troublefree and exactly controllable manner. From the beginning, an accumulation of fibers in the relatively acute angle between the feed portion, e.g. a conveyer belt or a gravity chute plate, and the opening rollers may be prevented. The feed roller allows an automatic control of the material supply to the opening rollers in a simple and effective way. At the same time, a controlled influence on the size of the flocks which shall be supplied to the opening rollers is possible. The control is substantially independent from the pressure of the material column in the filling chamber. The material may flow uniformly and homogeneously. Further, a purposeful automation is easily achievable for the feed of the fibers to the opening rollers. The arrangement of the supply roller at the respective point is also less expensive than the use of a lattice which is easily subjected to wear.

According to another feature of the invention, the supply roller shall rotate at a speed within a range of about 1/7 and 1/10 of the speed of the superposed opening rollers. By the slow rotation of the supply roller, the fiber material may be seized perfectly and safely to be delivered to the opening rollers running at a considerably higher speed. The opening effect may be improved as well. It is favorable for the supply roller to be provided with a drive of its own so that the adjustability is ensured by simple means. The amount of fiber material supplied may be easily regulated. The sense of rotation of the supply roller may be identical to that of the opening rollers.

Moreover, if a supply roller precedes the opening rollers, it is easier to get rid of trash in the fiber materials accumulating in the triangle between the feed system and supply roller. Because the fiber material cannot pile up and this effect may be considerably supported in that there is mounted a trough element movable longitudinally and/or transversely in advance of the supply roller. The trough element may be a perforated plate, preferably with elongated slots, or a comb-type grid. At least one movable trough portion may be designed as a driven oscillation element. The movement may be transferred in connection with the rotating supply roller by the trough element into the fiber material ready for working. This favors the drop of dirt particles and other trash through the perforated trough portion by which the filling chamber of the device is confined. The dirt particles are easily separated from the fibers or flocks of fiber material, and drop through the perforated trough plate and out of the filling chamber.

Further, the fiber material in the filling chamber of the assembly may be still dedusted additionally in that its upper part comprises a dust absorbing system. The material thrown into the filling chamber by the stripper roller mounted above the opening roller may be dedusted by absorption in flight. In case of the more or less intense circulation of the fibers in the filling chamber, the material transported to the opening roller is additionally subjected to an effective dedusting. It is suitable, in this connection, to provide above the stripper roller an inclined surface which serves for rebounding the fibers thrown away from the stripper roller.

To ensure that the cleaned fiber material is perfectly discharged by a suction air current, the suction channel extending tangentially to the opening roller is of a nozzle-type design. The feed for the suction current to the take-off roller is tapered while the continuation of the suction channel is flared like a nozzle. Preferably, the take-off roller extends considerably into the cross-section of the suction channel. The cross-section left free in the suction channel between take-off roller and opposite wall of the suction channel is as narrow as possible. Preferably, the free space is about ¼ or less of the channel crosssection as seen in the transverse plane of the take-off roller.

All of the indicated measures are provided to perform a highly effective fine-opening and cleaning of the spinning material by using relatively simple means.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 shows an elevational and schematic view of one embodiment of the apparatus of the invention for fineopening and cleaning fiber material comprising an automatic guide of impurities; and FIG. 2 is a top plan view according to line 2—2 of FIG. 1 schematically illustrating the slotted design of the trough plate at the supply roller.

DESCRIPTION OF A PREFERRED EMBODIMENT

A textile apparatus 1 for fine-opening and cleaning fiber material flocks, preferably of cotton or the like comprises a housing 2 accommodating a filling chamber 3 with feed opening 4. Opening rollers 5 and 6 are provided at one side of the filling chamber 3 while the superposed roller 7 is a stripper. A take-off roller 8 cooperates with the opener rollers 5 and 6. Beneath the take-off roller 8, there are provided cleaning grids 10 and 11. The separated and opened fiber material is conveyed upwardly through a channel 12 by means of an air current. There is a funnel-type waste chamber 13 from which waste may be carried away, e.g. by a worm conveyor 14. On the other side of the filling chamber, a chute plate 15 extends tangentially to a supply roller 16 adjacent opening roller 6. The diameter of supply roller 16 is considerably smaller than that of the three-superposed rollers 5, 6, 7 and its speed is also substantially less than that of the two subsequent opening rollers 5 and 6. Preferably, the speed of supply roller 16 is within a range of about 1/7 and 1/10 of the speed of the opening rollers 5 and 6. While the speed of the opening rollers 5 and 6 is, for instance, 400 rpm, the supply roller 16 is driven at a speed of 50 rpm. The supply roller 16 is provided with a drive of its own, e.g. motor 17 with transmission member 18. Supply roller 16, opening rollers 5 and 6 and stripper roller 7 as well as take-off roller 8 may be driven together by motor 20. However, the stripper roller 7 shall rotate at a speed substantially higher than that of the opening rollers 5 and 6, e.g. double the speed and more. The speed of the take-off roller 8 is conveniently double to six times that of the opening rollers 5 and 6. Rollers 16, 6, 5, and 7 may rotate clockwise while the take-off roller 8 should rotate counterclockwise.

Adjacent supply roller 16, trough-shaped chute 15 is provided with a transverse narrow slot 22 to ensure a free drop of dirt particles. Further, surfaces 23, 24 of troughshaped chute 25 comprise slots so that dirt particles may additionally drop through into waste chamber 13. Use may be made of a trough-shaped plate, preferably with elongated slots or of one having a comb-type design. At least one of the trough-shaped plates 24, 25 should be movable so that its travel in a conveying direction of the fiber material and/or transversely thereto is possible or that it may be oscillated. To this effect, trough portion 24 may be supported pivotally about axis 25. By means of a driving unit 26, the trough portion 24 may be maintained in a constant up and down movement, or oscillation. An optimum separation of the waste particles contained in the fiber material is effected. While the waste particles may drop through the holes or slots, the fibers rest on the surfaces of the trough portions and, by the pressure of the superposed material column, they are shifted towards the supply roller 16. The cleaning intensity is relatively high accordingly.

The fiber material taken along by the stripper roller 7 is cast back into the filling chamber 3. Its major amount impacts on inclined housing wall **27*a* serving as a rebounding element. By means of a dust suction tube 28, the fine dust is absorbed. The rebounding wall 27*a* may be supplemented by an adjacent rebounding face 27*b***. The achieved dedusting of the fiber material provided for fine opening is intense.

Suction channel 12 extending tangentially to take off roller 8 is of a nozzle-type design. The feed portion 30 for the suction air current is tapered towards take-off roller 8. The continuation 31 of the suction channel 12 may be subsequently flared like a nozzle, it being possible that, in the region of the stripper roller 8, part of the channel cross-section remains unchanged. A high suction effect is realized in that the take-off roller extends as far as possible into the cross-sectional surface of the suction channel 12, 32, thus causing a very narrow free cross-section between the take-off roller 8 and the wall 32 of the suction channel. For instance, about $\frac{1}{4}$ of the channel cross-section, seen in the transverse plane of the take-off roller, shall be left free only. The distance is still reducible with a resultant, still more effective, drawing effect of the suction air current through channel 12.

While a preferred embodiment of the invention has been described using specific terms, such description is for illustrative purposes only, and it is to be understood that changes and variations may be made without departing from the spirit or scope of the following claims.

What is claimed is:

1. Textile apparatus for fine-opening and cleaning textile fiber material in which the fiber material is fed to a filling chamber, a number of opening rollers in superposed arrangement disposed at a side of said filling chamber, said opening rollers followed by a take-off roller cooperating with a cleaning means by which said fiber material is conveyed by an air suction current through a channel to be supplied to a textile processing machine characterized in that a supply roller is disposed within said filling chamber adjacent one of said opening rollers, and said supply roller has a smaller diameter and rotates at a substantially slower speed than said superposed opening rollers.

2. Apparatus of claim 1 , wherein said supply roller rotates at a speed in a range of about 1/7 to 1/10 of the speed of the superposed opening rollers.

3. Apparatus of claim 1, wherein said supply roller is provided with a drive independent from said opening rollers.

4. Apparatus of claim 1, wherein said supply roller rotates in the same direction as said superposed rollers.

5. Apparatus of claim 1 including at least one movable trough means disposed in said filling chamber in advance of said supply roller.

6. Apparatus of claim 5, wherein said trough means includes a plurality of perforations through which trash particles may fall.

7. Apparatus of claim 1 including a trough-shaped chute disposed in said filling chamber having a first perforated portion and a second perforated portion, and that said first and second perforated trough portions are movable as driven oscillation elements.

8. Apparatus of claim 1 including a top side of said filling chamber in communication with a dust suction tube.

9. Apparatus of claim 1 including a stripper roller carried in said filling chamber, and angularly extending rebounding walls are disposed above said stripper roller.

10. Apparatus of claim 9 including a cover covering said stripper roller forming part of said filling chamber.

11. Apparatus of claim 1 including a stripper roller disposed adjacent one of said opening rollers which rotates at about double the speed of said opening rollers, and said take-off roller is arranged adjacent said opening rollers having a rotational speed of about double to six times the rotational speed of said opening rollers.

12. Apparatus of claim 1 including a suction channel extending tangentially to said take-off roller having a nozzle-type design which includes a feed portion for feeding the suction air current to said take-off roller having a tapered nozzle configuration, and a discharge portion which is a continuation of the suction channel having a flared nozzle configuration.

13. Apparatus of claim 12, wherein said take-off roller extends into the cross-section of said suction channel, and a free space is defined in said suction channel between said take-off roller and an opposite wall of said suction channel which is narrowed relative to said suction channel.

14. Apparatus of claim 13, wherein said free space has a cross-section of about ¼ of the channel cross-section or less, as seen in transverse plane of said take-off roller.

15. Textile apparatus for the fine opening and cleaning of textile fiber material of a type which includes a filling chamber to which the fiber material is fed, a number of opening rollers in superposed arrangement disposed at a side of filling chamber, a take-off roller disposed in fiber take-off relation to said opening rollers, air suction means through which fiber material is removed from said take-off rollers and is conveyed to an associated textile processing machine, wherein said apparatus comprises:

an independently driven supply roller disposed in said filling chamber adjacent a lower one of said opening rollers in said superposed arrangement for supplying fiber material to said opening rollers; and trough means disposed within said filling chamber adjacent said supply roller having a plurality of perforations through which trash separated from said fiber material may fall as said fiber material is fed to said opening rollers by said supply roller.

16. Apparatus of claim 15, wherein said trough means is movably mounted in said filling chamber, and means for driving said trough means in oscillations to increase the separation of the trash from said fiber material.

17. Apparatus of claim 15, wherein said supply roller has a smaller diameter and rotates at a slower speed than said opening rollers.

18. Textile apparatus for the fine opening and cleaning of textile fiber material comprising:

a filling chamber having a feed opening to which fiber material is fed;

a plurality of opening rollers disposed in said filling chamber in a generally superposed arrangement;

a take-off roller disposed in fiber take-off relation with said opening rollers;

fiber conveyor means for conveying said fiber material removed by said take-off rollers away from said filling chamber by air currents;

a supply roller disposed adjacent a lower one of said opening rollers; and a stripper roller carried adjacent an upper one of said opening rollers for stripping fiber material from said opening roller and delivering said fiber material back into said filling chamber.

19. Apparatus of claim 1 8 including a dust absorption system included in said filling chamber which includes means for removing dust from said filling chamber adjacent said stripper roller.

20. Apparatus of claim 19, wherein said dust absorption system further includes dust rebounding wall surfaces formed at angles in said filling chamber against which dust flying off of said stripper roller rebounds for removal from said filling chamber.

21. Apparatus of claim 18, wherein said supply roller has a smaller diameter than said opening rollers and rotates at a speed in a range of about 1/7 to 1/10 of the speed of said opening rollers.

22. Apparatus of claim 18 including oscillating trough means disposed adjacent a lower portion of said filling chamber adjacent said supply roller having perforations through which trash separated from said fiber material by the oscillations of said trough means may fall prior to being supplied to said opening rollers by said supply roller.

* * * * *